United States Patent [19]

Hunter et al.

[11] Patent Number: 4,784,527

[45] Date of Patent: Nov. 15, 1988

[54] MODULAR DRILLING TEMPLATE FOR DRILLING SUBSEA WELLS

[75] Inventors: Andrew F. Hunter; Wen J. Wang; Jeffrey L. Mueller, all of Houston, Tex.

[73] Assignee: Conoco Inc., Ponca City, Okla.

[21] Appl. No.: 55,678

[22] Filed: May 29, 1987

[51] Int. Cl.[4] ..... E02B 17/00; E21B 43/01

[52] U.S. Cl. ..... 405/207; 166/339; 166/366; 405/209; 405/227

[58] Field of Search ..... 405/195, 205, 207, 208, 405/209, 224, 227; 166/338, 339, 341, 366

[56] References Cited

U.S. PATENT DOCUMENTS

| | | | |
|---|---|---|---|
| 4,039,025 | 8/1977 | Burkhardt et al. | 405/227 X |
| 4,126,183 | 11/1978 | Walker | 166/338 |
| 4,155,672 | 5/1979 | Franks | 405/211 |
| 4,174,011 | 11/1979 | Zaremba | 166/366 |
| 4,194,857 | 3/1980 | Chateau et al. | 405/203 |
| 4,212,562 | 7/1980 | Stone et al. | 405/195 |
| 4,286,665 | 9/1981 | Walker | 166/339 |
| 4,408,932 | 10/1983 | Cowan | 405/227 |
| 4,426,173 | 1/1984 | Richart et al. | 405/195 |
| 4,497,592 | 2/1985 | Lawson | 405/227 X |
| 4,674,920 | 6/1987 | Regan et al. | 405/227 |
| 4,687,062 | 8/1987 | Beghetto et al. | 405/227 X |

*Primary Examiner*—David H. Corbin

*Attorney, Agent, or Firm*—Richard K. Thomson

[57] ABSTRACT

A light-weight, modular drilling template. A template is constructed of light-weight tubular steel having ring stiffeners to provide adequate crush resistance to withstand collapse under hydraulic loading provided by water pressure at 1800 feet water depth. The template is constructed as a pod-receiving frame with separable pods that may be installed after the frame has been set on the seafloor and leveled. The individual pods may be fine tune leveled by means of adjustable jacking mechanisms that form part of the latching devices that secure the pods to the frame. A method for installing a foundation template subsequent to installing the drilling template is also described.

20 Claims, 4 Drawing Sheets

MODULAR DRILLING TEMPLATE FOR DRILLING SUBSEA WELLS

BACKGROUND AND SUMMARY OF THE INVENTION

The present invention relates to a template for facilitating the drilling of subsea oil and gas wells. More particularly, the present invention relates to a light-weight, cost-effective, modular design for such a template that can more easily be installed and leveled.

The drilling template of the present invention was specifically designed for utilization in commercializing a field in the Gulf of Mexico off the Louisiana coast in approximately 1800 feet (550 m) of water. Soundings of the ocean floor targeted for template supporting a conventional drilling template. This suggested a light weight configuration might be in order. On the other-hand, placement in water depths of 1800 feet, necessitates a design with sufficient strength to avoid collapsing under the hydraulic pressure exerted by the ocean. Therefore, weight reduction could not be made without regard to strength requirements.

The template design of the present invention affords both a light-weight solution and a configuration having sufficient strength to survive the rigors of the environment at a 1800 foot water depth. A frame is constructed of tubular steel members that are reinforced with ring stiffeners. The frame defines a number of (in the specific embodiment shown, six) pod-receiving openings. Well pods, that may be installed as necessary to enable the drilling to proceed, are secured into the individual openings and, preferably, provide cylindrical guides for drilling a plurality of (in the specific embodiment depicted, four) wells.

The light-weight template frame is equipped with a plurality of buoyancy tanks (at least some of which are floodable and one, removable) to enable the template to float at the field site so that it may be rigged for placement on the ocean floor. The floodable tanks may then be ballasted to the weight desired by controling valved flood ports, for floor installation. Cathodic protection is provided in the form of sacrificial anodes mounted at spaced locations along the tubular frame. The pile sleeves of the frame are provided with conventional slips to grip the pin piles that are used to secure the template to the seafloor. By engaging the template near its lowest corner and lifting, a rough level for the template (which is roughly 50 feet by 80 feet by 20 feet at its tallest end) can be obtained.

The individual well pods can be inserted in the openings and are secured in place by engagement of a plurality of latch mechanisms in a like plurality of latch-engaging receptacles. A fine tune adjustment of the level of the individual pods can be made by adjustment of gimbaled jack mechanisms associated with each of the latches.

The modular template has several advantages over conventional one piece designs. The weight reduction to facilitate leveling has already been mentioned. Another is cost avoidance or, at least, cost postponement, since subsequent will pods need only be added as successful drilling indicates installation to be warranted. Yet, another is that a pod that is damaged may be retrieved and repaired or replaced before drilling commences. In a conventional template design, no such flexibility is afforded and a damaged cylindrical guide for the drill string generally precludes the intended well from being drilled or requires significant effort to repair or replace it on the ocean floor.

Yet another feature of the present invention involves the placement of the drilling and foundation templates. The drilling template may be lowered and secured in place with piles, the docking pile guide frames attached in position, and the docking piles installed. When production becomes imminent, the foundation template may be set around the drilling template and the production platform secured thereto. This also allows the cost associated with the placement of the foundation template to be avoided, or at least delayed, until the delineation drilling has shown the field under development to have significant commercial potential.

Various other features, advantages and characteristics of the present invention will become apparent after a reading of the following description.

DETAILED DESCRIPTION OF THE PREFERRED EMBODIMENT(s)

Figure 1:
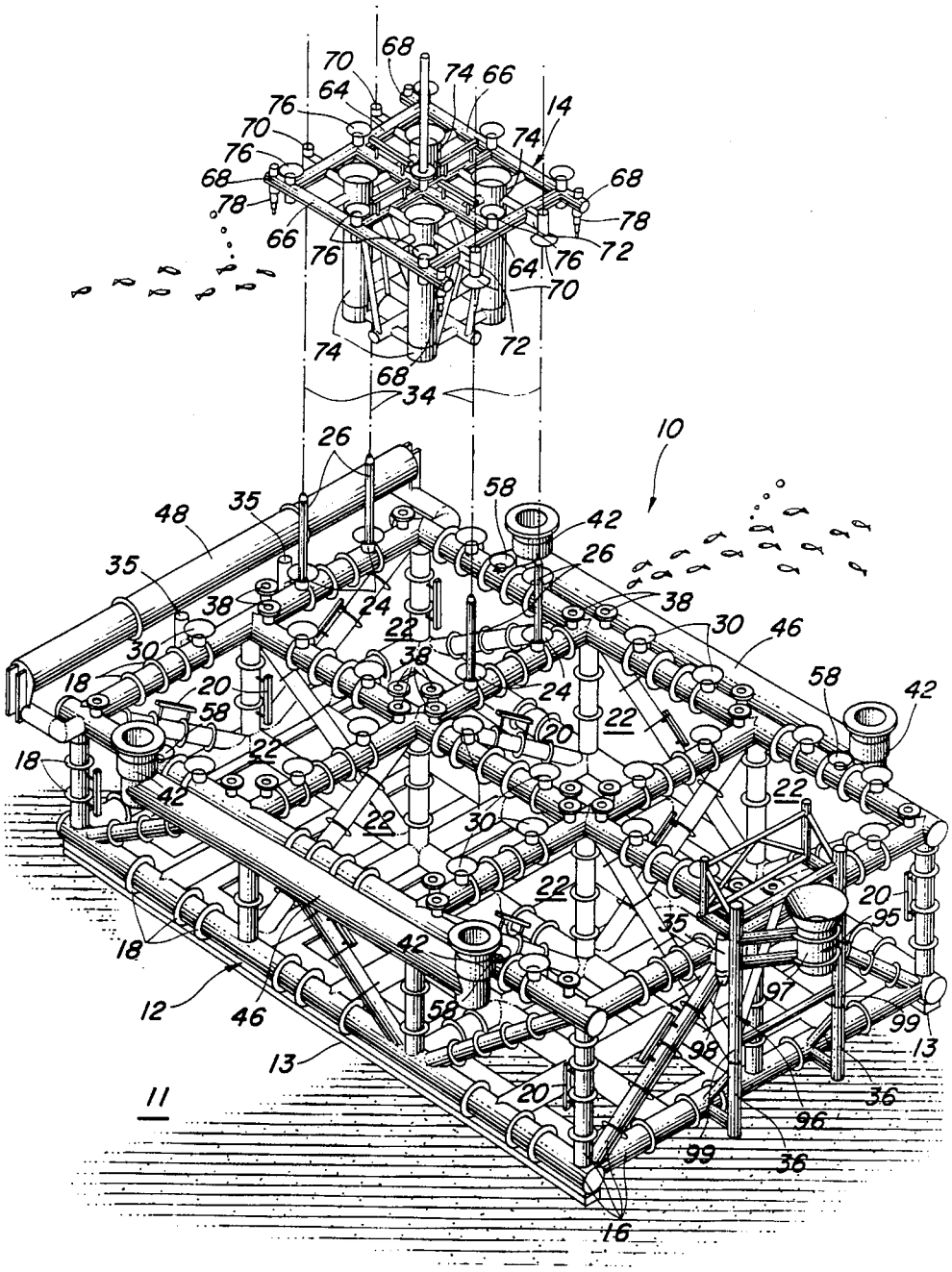
FIG. 1 is an exploded elevational view of the modular template of the present invention showing the template frame as it would be configured for floating on the surface and indicating how a pod would be received in an opening.

The drilling template of the present invention is shown in FIG. 1 generally at 10. Template 10 is comprised of two main components: a light-weight tubular frame 12 and a plurality of (one shown) well pods 14. Frame 12 is constructed of tubular members 16 that have ring stiffeners 18 formed thereon to stiffen (or reinforce) tubular members 16. Ring stiffeners 18 provide the walls of tubular members 16 with sufficient strength, in conjunction with the wall thickness, to prevent the walls from collapsing under the hydraulic pressure from the 1800 foot water depth. Sacrificial anodes 20 are affixed periodically along the lengths of members 16 to inhibit cathodic reaction on the subsea template 10. Tubular frame members 16 define a plurality of pod-receiving openings 22 (six being shown).

Figure 3:
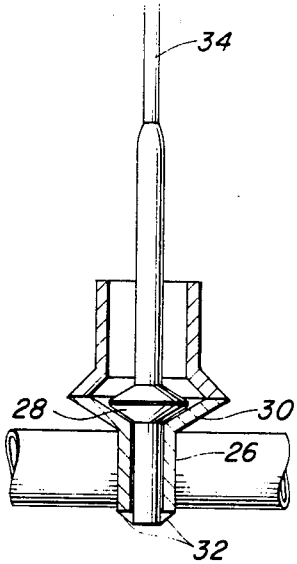
FIG. 3 is a detailed side view in partial section of one of the guide rods with the pod positioned in the template frame.

Template frame 12 will be mounted on a pair of wooden skids 13 to facilitate its removal from a launching barge, or the like. Positioned around the periphery of each pod receiving opening 22 are a plurality of receptacles 24 that may selectively receive guide rods 26. As shown in FIG. 3, each guide rod 26 has a frusto-conical seat 28 that is received in conically shaped funnel 30 of receptacle 24. One or more retractable dog(s) 32 protrudes below the bottom of receptacle 24 and latches guides rod 26 in place. A guide wire 34 extends from each guide rod 26 to the surface for the purpose of guiding well pod 14 into proper position in its respective opening 22. Guide wires 34 and guide rods 26 will also be used to properly locate other items such a pin piles and docking piles, as well.

Also located about the periphery near the corners of each opening 22 are a plurality of latch-engaging tubes 38 which are also each equipped with conical guide funnels 39 to facilitate entry of latch mechanisms 40 of well pods 14. A plurality of pile sleeves 42 (four shown) are provided for receiving pin piles 44 (FIG. 2) to affix template 10 in a particular location on the seafloor 11. Buoyancy tanks 46 extend between pairs of sleeves 42 and a removable tank 48 is mounted adjacent one end of template frame 12. Buoyancy provided by tanks 46 and 48, as well as by tubular frame members 16 themselves, enable the template to float at the drillsite so that it may be rigged with a sling to lower it to the seafloor using a drill string, or the like. Tank 48 is removed and tanks 46 and the remainder of frame members 16 are ballasted to provide the desired lowering weight by opening valved ports (not shown) located on the various structural members.

Once template 12 is seated on the seafloor 11, pin piles 44 are inserted into the ocean floor through sleeves 42 using any one of a number of conventional pile driving or drilling techniques. the technique preferred for this application involves the use of a tubular pile through which a drill string can be inserted. As the hole is drilled through the pile, the weight of the pile causes it to sink into the muddy bottom. By way of example, pin piles 44 that are 280 feet in length will be drilled 250 feet or so into the ground (some 25–30 feet protruding from the seafloor 11).

Figure 2:
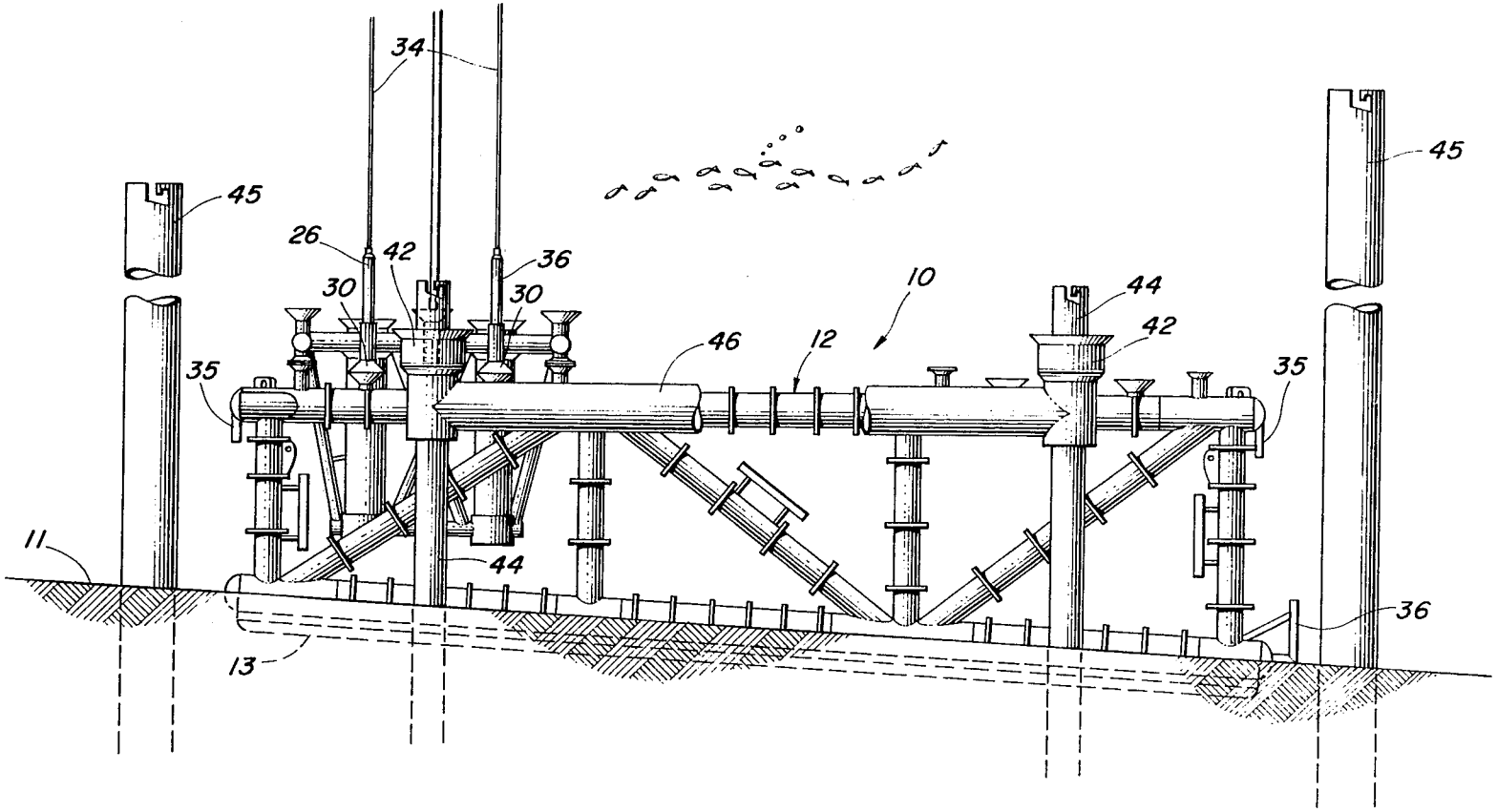
FIG. 2 is a side view of the modular template frame with parts broken away, said frame piled and leveled on the seafloor with the docking piles installed and the first pod inserted and secured in its opening.
Figure 4:
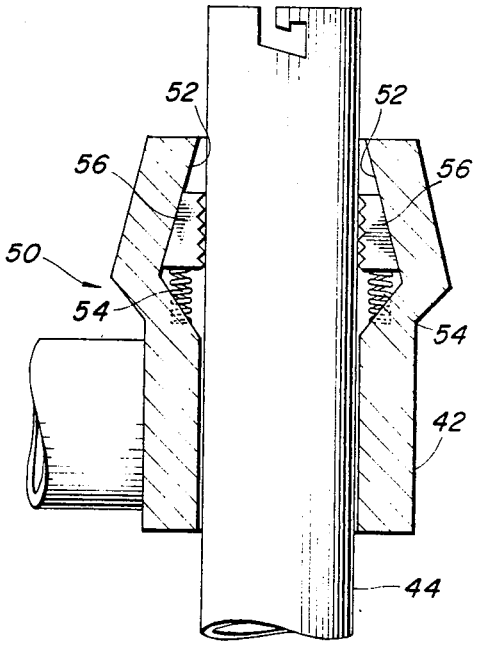
FIG. 4 is a detailed side view in partial section of an examplary slip mechanism that may be used for rough leveling the template.
Figure 5:
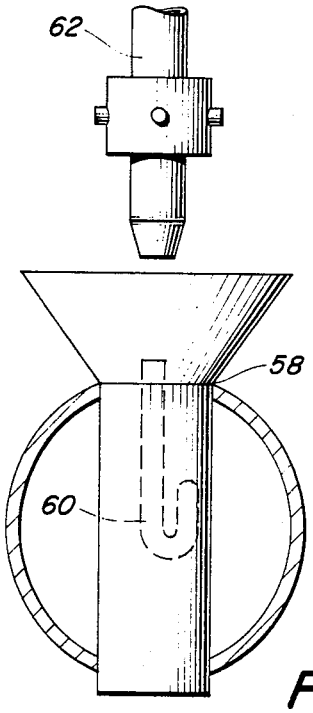
FIG. 5 is a detailed side view in partial section of the J-latch receptacle engaged by a running tool to facilitate rough leveling.

As shown in FIG. 2, the seafloor 11 designated for template installation has an incline of approximately 6°. The template frame 12 is constructed with a complementary taper to make the upper template surface generally level. Each pile sleeve 42 is equipped with a slip assembly 50 (FIG. 4) to facilitate a coarse leveling of the template (within 1°) should one corner sink more deeply into the soil or, if for any other reason, the template prove to be out of level. These slip assemblies 50 may be uni-directional (i.e., resist only downward motion) through mechanical devices such as camming surfaces 52 and springs 54 that bias arcuate slips 56 into engagement with the surface of pile 44. Alternatively, the slips may be actuated to engage piles 44 by hydraulic, pneumatic or electronic (e.g., solenoid) means, as shown in U.S. Pat. No. 4,212,562, for example.

The template frame 12 is equipped with a receptacle 58 adjacent each pile sleeve 42. Receptacles 58 each have a J-latch slot 60 engagable by a running tool 62. Should the template frame 12 not be leveled within design tolerance (1°, as mentioned earlier), running tool 62 will be engaged in J-latch slot 60 of the lowermost sleeve 42 and raised, as needed. Both the initial level and the effect of the adjustment will be detected by a video camera mounted within a remotely operated vehicle used to view the leveling bubbles (not shown) positioned on lateral and longitudinal frame members 12. The adjustment of the template pile sleeves will continue as necessary until the degree of level desired is provided.

Figure 7:
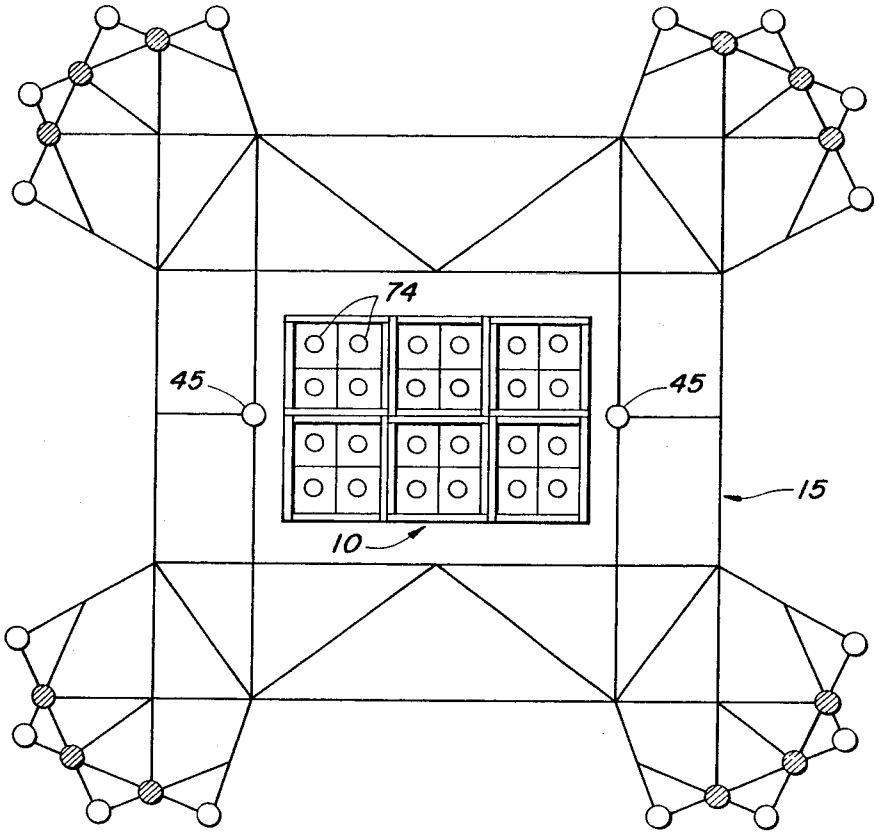
FIG. 7 is a schematic top view showing how the foundation template is positioned around the drilling template.

Pod 14 comprises a generally rectangular frame formed by lateral members 64 and longitudinal members 66. Actually, lateral members 64 and longitudinal members 66 define a square that can be received inside pod-receiving openings 22. End extensions 68 of longitudinal members 66 protrude outwardly from the square such that latch mechanisms 40 overlie the centerlines of frame members 16 so that they may be secured in latch-engaging tubes 38. Pod guide sleeves 70 are similarly mounted on arms 72 to overlie and engage guide rods 26. This length difference requires that pods 14 be installed in template openings parquet-style, alternately extending laterally and longitudinally in adjacent pod-receiving openings 22. By examining the differences in the positions of the guide rods 26 between FIG. 1 and FIG. 2 (FIG. 1 depicting a pod in the back corner, FIG. 2 the front corner), one can appreciate the consequences of this parqueting. The specific parquet patern is shown schematically in FIG. 7.

Pod 14 supports one or more cylindrical sleeves 74 for guiding a drill string (not shown) during well drilling operations. The specific configuration depicted in the preferred embodiment shows pod 14 configured with four such sleeves 74. A plurality of guide rod receptacles 76 (eight shown) are positioned about the upper periphery of pod 14. Once pod 14 is secured in place, guide rods 26 will be retrieved by retracting dogs 32 and reeling in guide wires 34. The inside diameter of sleeve 74 is sufficient to permit unobstructed passage of frusto-conical seat 28. The same guide rods 26, or others, may then be received in receptacles 76 to permit other equipment, such as the drill string, to be lowered into position.

Figure 6:
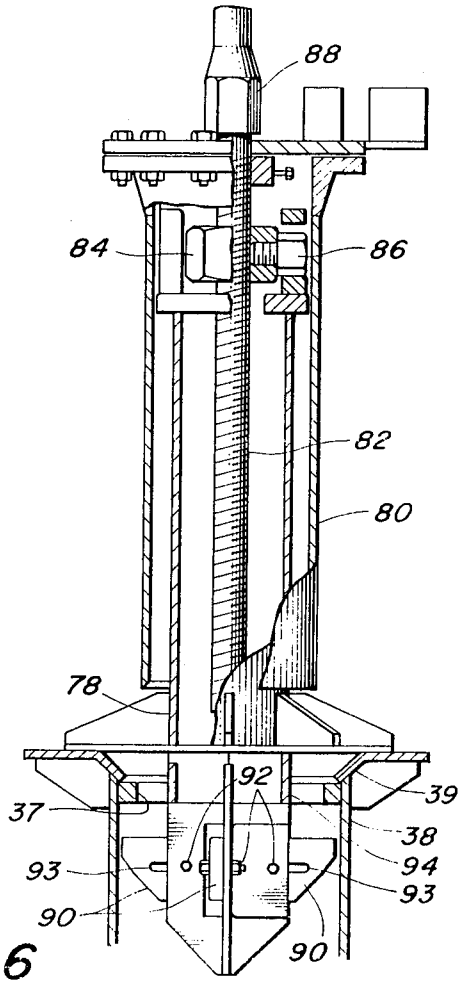
FIG. 6 is a detailed side view with portions cut away showing the latch mechanism and its associated leveling jack.

The details of latch and leveling mechanism 40 are shown in FIG. 6. An extendable leg 78 is telescopically received within leg 80 that is attached to pod 14. Extendable leg 78 is mounted on screw jack 82 by a gimbal nut 84. A pair of pivot pins 86 (one shown) are threaded into each side of gimbal nut 84 and rotationally support pivot frame 87 to which leg 78 is attached. By engaging and rotating hex head 88 on screw jack 82, leg 78 may be extended to provide the desired level of pod 14 and hence the verticality of cylindrical sleeves 74. This adjustment can be done at the surface before the pod is lowered or after the pod 14 is installed in its opening 22 by a remotely operated vehicle. The gimbaled nut 84 enables one leg 78 to be extended with respect to the other three without binding in the tubes 38. It will be appreciated that it is extremely important that sleeves 74 be vertical to help insure that the initial engagement of the drill string is not angular so that the wellbore, wellhead, and associated equipment will be vertically positioned. Leveling bubbles (not shown) on well pod 14 facilitate the fine tune leveling process.

Latching dogs 90 are slidably mounted by virtue of pins 92 received in slots 93 are secured to the lower end 94 of extendable leg 78. Springs (not shown) bias latching dogs 90 to their outward (or latching) position. Thus extended, dogs 90 will engage under inwardly protruding flange 37 formed within tubes 38 thereby preventing inadvertent removal of pod 14 from frame 12.

Detachable docking pile guide 95, one of which will be received on each end of template frame 12, is shown in FIG. 1 (one shown). Guide 95 comprises a frame 96 mounting a cylinder 97 that receives docking piles 45. Frame 96 includes a pair of cylindrical pins 98 that are received in sleeves 35, sleeves 35 forming part of frame 12. A similar pair of pins (not shown) are formed as extension of legs 99 that are received in tubular sleeves 36 that also form part of frame 12. Docking pile guide frames 95 may be attached to template fame 12 prior to lowering but, more preferably are run into place using guide wires connected to guide rods 26 after the template frame has been deposited and leveled on the seafloor 11. Docking piles 45 will be installed in a manner similar to pin piles 44 and need not be quite as long (piles 45 may, for example, be on the order of 200 feet long and drilled to a depth of 160 feet so that some 40 feet extends above the seafloor 11). Once piles 45 are in place, dock pile guides 95 may be retrieved as, for example, by retrieving guide rods 26. The aperture in the corresponding sleeve of the frame 95 will be insufficient to provide the clearance depicted in FIG. 3 and frame 95 will travel upwardly with rods 26.

When sufficient delineation wells have been drilled to confirm that sufficient barrels of oil and/or cubic feet of natural gas are in place to warrant full scale production, the foundation template 15 can be installed preparatory to anchoring the production platform (not shown) thereto. Docking piles 45 project will above the uppermost portions of template 10 and permit the foundation template to be properly located around the drilling template thereby avoiding damage to template 10. This enables postponement of the expenditure of funds associated with foundation template installation until after the formation has been proven to be commercial.

The drilling template of the present design is a light-weight configuration that provides a cost effective alternative that is much easier to install and level than conventional templates. A skeletal frame is installed and leveled on the seafloor and well pods installed as drilling proceeds. The design allows significant expenses associated with subsequent well pods and post installation of the foundation template to be postponed until a commercial reason to proceed has been demonstrated.

Various changes, alternatives and modifications will become apparent to one of ordinary skill in the art following a reading of the foregoing specification. Accordingly, it is intended that all such changes, alternatives and modifications as fall within the scope of the appended claims be considered part of the present invention.

We claim:

1. A modular template for drilling subsea oil and gas wells, said modular drilling template comprising:

(a) a frame constructed of light-weight tubular steel members, said frame defining a plurality of generally rectangular, pod-receiving openings, said plurality of openings having no drill string guide means permanently affixed thereto;

(b) guide rods projecting upwardly from said tubular steel members;

(c) latch-engaging means attached to said frame;

(d) a plurality of well pods receivable in said openings in said frame, each well pod having (i) at least one cylindrical sleeve for guiding a drill string, or the like;

(ii) pod guide sleeves for engaging said guide rods to properly position said well pod relative to said frame opening, and (iii) a latch mechanism insertable into said latch-engaging means so as to prevent inadvertent removal of said well pod from said frame opening.

2. The modular drilling template of claim 1 wherein at least some of said light-weight tubular steel members have annular ring stiffeners positioned periodically along their length for reinforcement.

3. The modular drilling template of clam 1 further comprising means to coarsely level the template frame relative to a portion of the seafloor after placement of said template frame thereupon.

4. The modular drilling template of claim 3 wherein said means to coarsely level said frame comprises slip means for engaging a pile securing said template to the seafloor.

5. The modular drilling template of claim 3 further comprising means on each individual pod to fine tune the leveling to insure that said at least one guide tube is positioned vertically.

6. The modular drilling template of claim 5 wherein said frame further comprises a plurality of receptacles positioned on said tubular steel members for receiving said upwardly projecting guide rods.

7. The modular drilling template of claim 5 wherein the means to fine tune the leveling comprise a plurality of jacking members provided on each well pod which each adjust a telescoping leg.

8. The modular drilling template of claim 7 wherein said jacking member is interconnected to said telescoping leg by gimbaling means.

9. The modular drilling template of claim 7 wherein said latch mechanisms comprises a plurality of spring-biased dogs mounted on a protruding end of said telescoping leg.

10. The modular drilling template of claim 9 wherein said latch-engaging means for securing the well pod to said frame further comprises a tubular receptacle with an inwardly protruding flange to engage said spring-biased dogs of each telescoping leg, said tubular receptacle forming a part of said frame.

11. The modular drilling template of claim 1 wherein each of said well pods comprises guide sleeves for a plurality of wells.

12. The modular drilling template of claim 1 wherein each of said well pods comprises guide sleeves for at least four wells.

13. The modular drilling template of claim 1 wherein at least some of said tubular frame members comprise buoyancy tanks.

14. The modular drilling template of claim 13 wherein at least some of said buoyancy tanks are floodable to provide ballast.

15. The modular drilling template of claim 13 wherein at least one of said buoyancy tanks may be removed prior to placement of said template on the seafloor.

16. The modular drilling template of claim 14 wherein virtually all of said tubular frame members can be flooded to provide ballast.

17. A method of installing a well drilling template and a foundation template for securing a drilling platform, which may be a tension leg platform, in place, said method comprising the steps of:

(a) lowering said drilling template to its location on the seafloor;

(b) removably attaching a plurality of docking pile guide frames to said drilling template;

(c) securing said drilling template in position with piles;

(d) installing a plurality of docking piles through said plurality of docking pile guide frames;

(e) lowering said foundation template into position around said drilling template guided by said docking piles;

(f) securing said foundation template in position.

18. The installation method of claim 17 further comprising the step of removing said docking pile guide frames from said drilling template before lowering said foundation template.

19. The installation method of claim 17 wherein said drilling template is of a modular design and includes a tubular frame defining openings for individual well pods, said method further comprising the steps of installing said tubular frame member first and installing well pods successively as necessary in order to facilitate a planned pattern of drilling which includes the drilling of a number of formation delineation wells.

20. The installation method of claim 19 wherein the foundation template installation step is performed only after the delineation wells indicate that the formation being drilled has sufficient commercial potential to warrant said installation.

* * * * *

UNITED STATES PATENT AND TRADEMARK OFFICE

CERTIFICATE OF CORRECTION

PATENT NO. : 4,784,527

DATED : November 15, 1988

INVENTOR(S) : Andrew F. Hunter, Wen J. Wang and Jeffrey L. Mueller

It is certified that error appears in the above-identified patent and that said Letters Patent are hereby corrected as shown below:

Column 1, line 16 - between words "template" and "supporting" add

--placement indicated a silty, unstable mud bottom that was incapable of--.

Column 1, line 62 - delete "will" and insert --well--.

Column 3, line 31 - delete "the" and insert --The--.

Column 5, line 3 - delete "fame" and insert --frame--.

Column 5, line 22 - delete "will" and insert --well--.

Column 6, line 3 - delete "clam" and insert --claim--.

Signed and Sealed this

Twenty-first Day of March, 1989

*Attest:*

DONALD J. QUIGG

*Attesting Officer*

*Commissioner of Patents and Trademarks*